US010041750B2

(12) United States Patent
Oglesby

(10) Patent No.: US 10,041,750 B2
(45) Date of Patent: Aug. 7, 2018

(54) BOLT CARRIER

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 22 days.

(21) Appl. No.: 14/931,061

(22) Filed: Nov. 3, 2015

(65) Prior Publication Data

US 2016/0123685 A1 May 5, 2016

Related U.S. Application Data

(63) Continuation-in-part of application No. 29/508,296, filed on Nov. 5, 2014, now Pat. No. Des. 754,273.

(60) Provisional application No. 62/075,299, filed on Nov. 5, 2014.

(51) Int. Cl.

| | |
|---|---|
| ***F41A 5/26*** | (2006.01) |
| ***F41A 3/26*** | (2006.01) |
| ***F41A 5/24*** | (2006.01) |
| ***F41A 13/00*** | (2006.01) |

(52) U.S. Cl.

CPC ..... *F41A 3/26* (2013.01); *F41A 5/24* (2013.01); *F41A 13/00* (2013.01)

(58) Field of Classification Search

CPC ..... F41A 5/26; F41A 3/12
USPC ..... 89/191.01–193
See application file for complete search history.

(56) References Cited

U.S. PATENT DOCUMENTS 2,951,424 A * 9/1960 Stoner ..... F41A 3/16 89/179
5,103,714 A * 4/1992 LaFrance ..... F41A 11/02 89/129.01
5,551,179 A * 9/1996 Young ..... F41A 3/12 42/16
6,848,351 B1 * 2/2005 Davies ..... F41A 3/94 89/191.01
7,784,211 B1 * 8/2010 Desomma ..... F41A 3/26 42/16
8,109,195 B1 * 2/2012 Spence ..... F41A 5/24 89/193
8,667,882 B1 * 3/2014 Larson ..... F41A 3/66 89/140
8,844,425 B2 * 9/2014 Mueller ..... F41A 3/84 42/1.06
8,910,406 B1 * 12/2014 Huang ..... F41A 3/66 42/16
9,528,793 B1 * 12/2016 Oglesby ..... F41C 23/16
2006/0236582 A1 * 10/2006 Lewis ..... F41A 3/26 42/73
2012/0137869 A1 * 6/2012 Gomez ..... F41A 3/26 89/125
2012/0152105 A1 * 6/2012 Gomez ..... F41A 5/20 89/191.01
2014/0041518 A1 * 2/2014 Neitzling ..... F41A 3/26 89/191.01

(Continued)

*Primary Examiner* — Troy Chambers
*Assistant Examiner* — Bridget A Cochran
(74) *Attorney, Agent, or Firm* — Shaddock Law Group, PC

(57) ABSTRACT

A bolt carrier having a first gas port, wherein the first gas port provides fluid communication between an interior and an exterior of the bolt carrier; a second gas port, wherein the second gas port provides fluid communication between an interior and an exterior of the bolt carrier; and a third gas port, wherein the third gas port provides fluid communication between an interior and an exterior of the bolt carrier.

20 Claims, 12 Drawing Sheets

(56) References Cited

U.S. PATENT DOCUMENTS

| | | | | |
|---|---|---|---|---|
| 2014/0060311 | A1* | 3/2014 | Christenson | F41A 5/18<br>89/191.01 |
| 2014/0075807 | A1* | 3/2014 | Lewis | F41A 15/14<br>42/25 |
| 2014/0076144 | A1* | 3/2014 | Gomez | F41A 3/38<br>89/132 |
| 2014/0144314 | A1* | 5/2014 | Jensen | F41A 3/64<br>89/193 |
| 2015/0267978 | A1* | 9/2015 | Miller | F41A 5/18<br>89/198 |
| 2016/0123685 | A1* | 5/2016 | Oglesby | F41A 3/26<br>89/180 |

* cited by examiner

BOLT CARRIER

CROSS-REFERENCE TO RELATED APPLICATIONS

This patent application claims the benefit of U.S. Patent Application Ser. No. 62/075,299, filed Nov. 5, 2014, and U.S. patent application Ser. No. 29/508,296, filed Nov. 5, 2014, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearm components. More specifically, the present invention relates to a bolt carrier adaptable to be used with a firearm.

2. Description of Related Art

A number of firearms operate based on a gas blowback system. One such firearm is the M-16, M-4, and AR-15 family of firearms. The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylindrical gas aperture 42 of the bolt carrier key 40, between the bolt carrier 20 and the bolt 50 and drives the bolt carrier 20 rearward.

The buffer, which is pushing on the rear of the bolt carrier group 10, is forced rearward by the bolt carrier group 10 compressing the recoil spring. During this rearward movement, a cam pin track or slot 22 in the upper portion of the bolt carrier 20 acts on the bolt cam pin 30, translating the rearward linear movement of the carrier into rotational movement, thereby rotating the cam pin 30 and bolt 50 clockwise so that the bolt locking lugs are unlocked from the barrel extension locking lugs. As the rearward movement of the bolt carrier group 10 continues, the empty cartridge case is extracted from the chamber, and ejected through the ejection port.

As the bolt carrier group 10 clears the top of an inserted magazine and the empty cartridge case is expelled, a new round is pushed into the path of the bolt 50 by the upward thrust of the magazine follower and spring.

As the bolt carrier group 10 continues to move rearward, it overrides the hammer and forces the hammer down into the receiver, compressing the hammer spring, and allowing the rear hook of the hammer to engage with the hammer disconnect.

When the bolt carrier group 10 reaches its rearmost position (when the rear of the buffer contacts the rear of the buffer tube), the compressed recoil spring expands, driving the buffer assembly forward with enough force to drive the bolt carrier group 10 forward, toward the chamber, initiating chambering of the waiting round from the magazine into the chamber.

The forward movement of the bolt 50 ceases when the locking lugs pass between the barrel extension locking lugs and the round is fully chambered. When the bolt carrier 20 enters the final portion of its forward movement, the bolt cam pin 30 emerges from the cam pin guide channel in the upper receiver and moves along the cam pin slot 22, rotating the bolt 50 counterclockwise. This rotation locks the bolt 50 to the barrel extension (by interaction of the bolt locking lugs and the barrel extension locking lugs). The locking of the bolt 50 completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical bolt carrier arrangement has various shortcomings. For example, as the firing cycle occurs, gases and debris are expelled into the interior of the upper receiver.

In various exemplary, non-limiting embodiments, the bolt carrier comprises specifically designed gas port apertures or holes that vent propellant gases in a specific, unique direction.

Unlike known bolt carriers, the rear portion of the bolt carrier features a larger diameter "boss" that maintains the bolt carrier at a more consistent angle within the upper receiver and/or the buffer tube aperture of the firearm, particularly as the bolt carrier moves through a firing cycle. In contrast, known bolt carriers can "hang" off the bolt.

In various exemplary, nonlimiting embodiments, the bolt carrier of the present disclosure comprises a first gas port, wherein the first gas port provides fluid communication between an interior and an exterior of the bolt carrier, wherein the first gas port extends from an initial portion to a subsequent portion, wherein said initial portion has a longitudinal axis that is offset approximately 45° from a longitudinal axis of the bolt carrier, and wherein the subsequent portion has a longitudinal axis that is offset approximately 10° to 15° from the longitudinal axis of the bolt carrier; a second gas port, wherein the second gas port provides fluid communication between an interior and an exterior of the bolt carrier, and wherein said second gas port has a longitudinal axis that is offset approximately 70° to 75° from the longitudinal axis of the bolt carrier; and a third gas port, wherein the third gas port provides fluid communication between an interior and an exterior of the bolt carrier, and wherein said third gas port has a longitudinal axis that is offset approximately 30° to 40° from the longitudinal axis of the bolt carrier.

In certain exemplary, nonlimiting embodiments, a gas trough is formed along at least a portion of the exterior of the bolt carrier.

In certain exemplary embodiments, the bolt carrier further includes a boss formed proximate a rear portion of the bolt carrier.

In certain exemplary embodiments, the bolt carrier further includes one or more relief cuts formed proximate a rear portion of the bolt carrier and/or within the boss.

Accordingly, the present disclosure provides a bolt carrier that vent propellant gases in a specific direction.

The present disclosure separately provides a bolt carrier that is heavier than a standard bolt carrier, thereby providing more mass to the bolt carrier.

The present disclosure separately provides a bolt carrier that may be utilized in conjunction with a domed head cam pin.

The present disclosure separately provides a bolt carrier that operates cleaner and flatter than known bolt carriers.

The present disclosure separately provides a bolt carrier that is smoother in operation than standard carriers.

The present disclosure separately provides a bolt carrier that allows propellant gases to flow out more quickly and softens the cycling action of the firearm.

The present disclosure separately provides a bolt carrier that does not pressurize the upper receiver, as compared to standard bolt carriers.

The present disclosure separately provides a bolt carrier that does not force propellant gases into the users face through the charging handle gap, particularly on short barrel or suppressed rifles.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary and may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
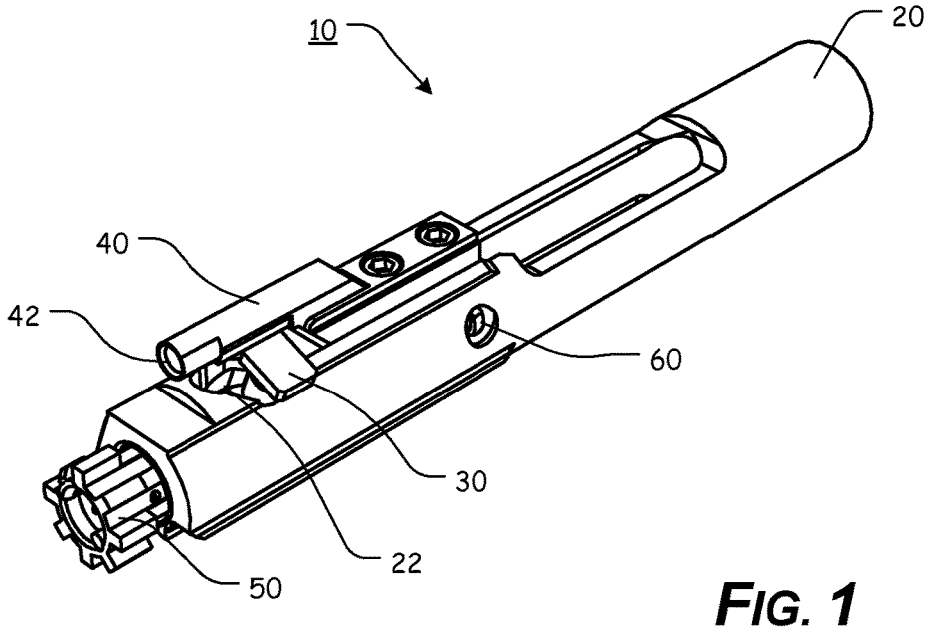
FIG. 1 PRIOR ART
FIG. 1 illustrates an upper, left, front perspective view of a known bolt carrier group.

For simplicity and clarification, the design factors and operating principles of the bolt carrier disclosed herein are explained with reference to various exemplary embodiments of a bolt carrier according to this invention. The basic explanation of the design factors and operating principles of the bolt carrier is applicable for the understanding, design, and operation of the bolt carrier of this invention. It should be appreciated that the bolt carrier can be adapted to many applications where a bolt carrier can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "bolt carrier group", "bolt carrier", and "firearm" are used for basic explanation and understanding of the operation of the systems, methods, and apparatuses of this invention. Therefore, the terms "bolt carrier group", "bolt carrier", and "firearm" are not to be construed as limiting the systems, methods, and apparatuses of this invention.

For simplicity and clarification, the bolt carrier of this invention will be described as being used in conjunction with a firearm, such as a rifle or carbine. However, it should be appreciated that these are merely exemplary embodiments of the bolt carrier and are not to be construed as limiting this invention. Thus, the bolt carrier of this invention may be utilized in conjunction with any firearm.

Turning now to the drawing FIGS., FIGS. 1-20 illustrate certain elements and/or aspects of a first exemplary embodiment of the bolt carrier 100, as disclosed herein. In illustrative, non-limiting embodiment(s) of this invention, as illustrated in FIGS. 1-20, the bolt carrier 100 comprises an elongate bolt carrier 100 extending from a first end to a second end.

Figure 2:
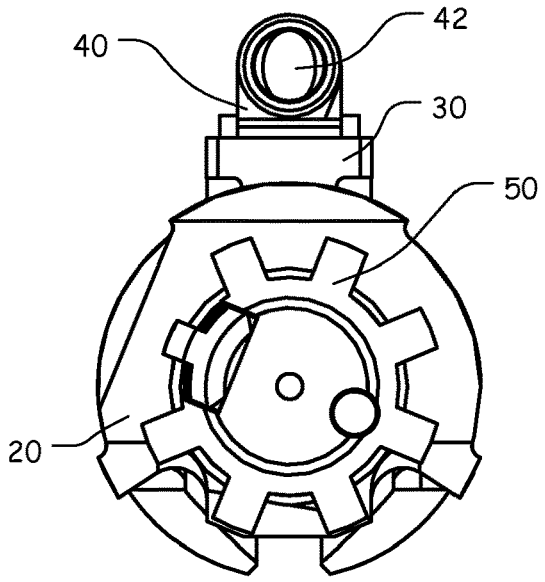
FIG. 2 PRIOR ART
FIG. 2 illustrates a front view of a known bolt carrier group in an unlocked position.
Figure 3:
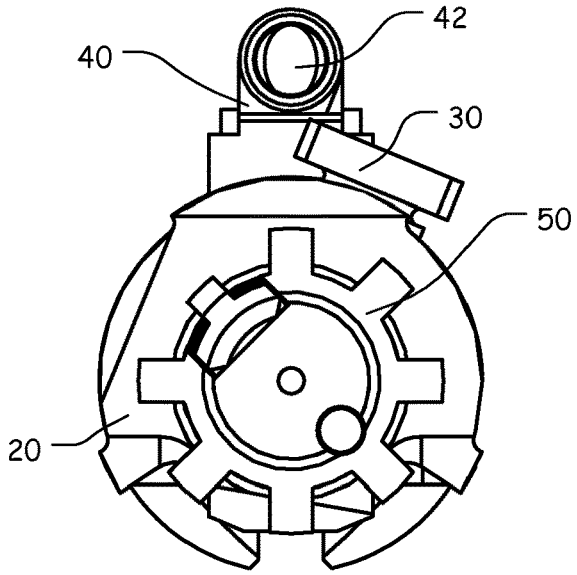
FIG. 3 PRIOR ART
FIG. 3 illustrates a front view of a known bolt carrier group in a locked position.
Figure 4:
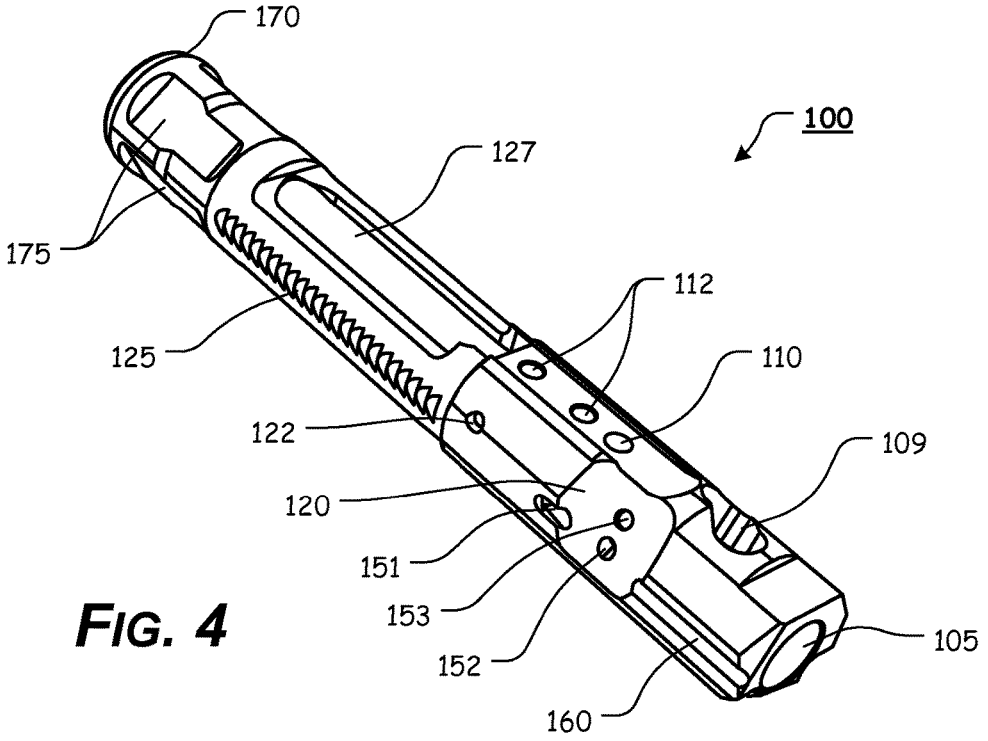
FIG. 4 illustrates an upper, right, front perspective view of an exemplary embodiment of a bolt carrier, as disclosed herein.
Figure 5:
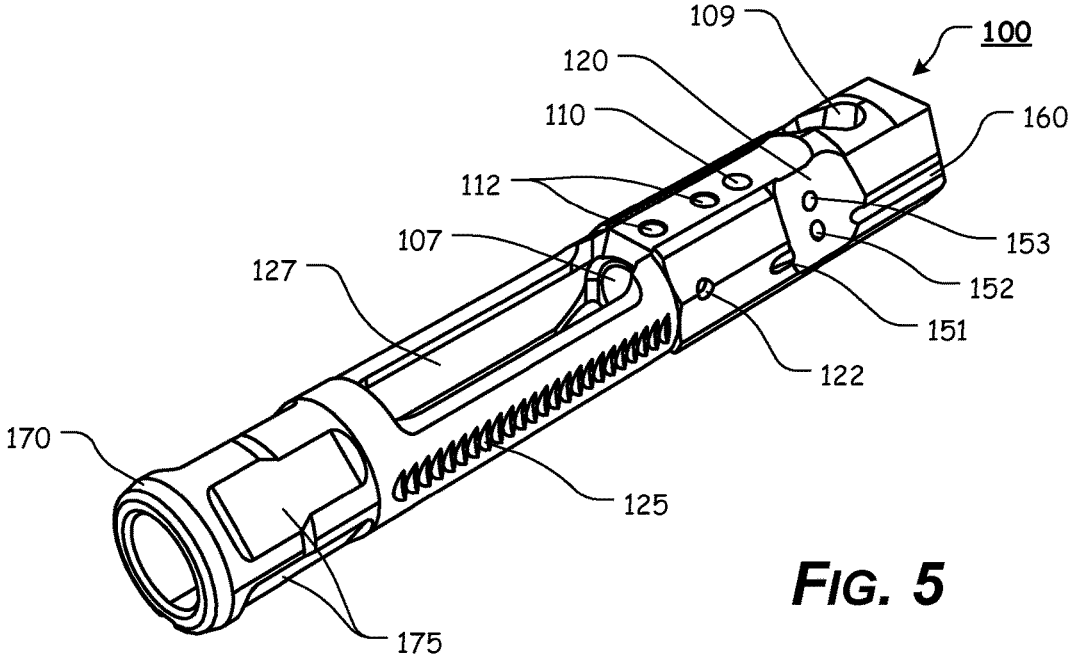
FIG. 5 illustrates an upper, right, rear perspective view of an exemplary embodiment of a bolt carrier, as disclosed herein.
Figure 6:
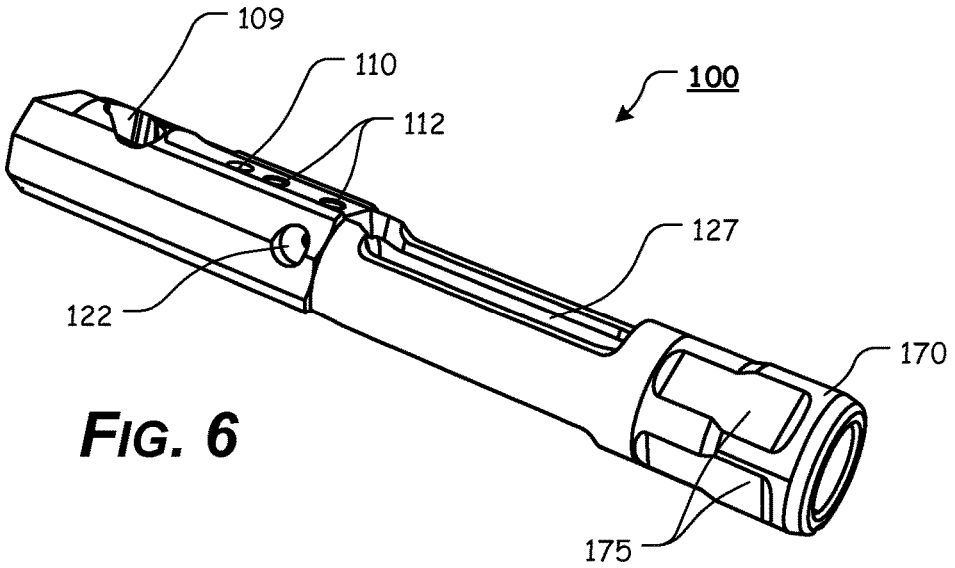
FIG. 6 illustrates an upper, left, rear perspective view of an exemplary embodiment of a bolt carrier, as disclosed herein.
Figure 7:
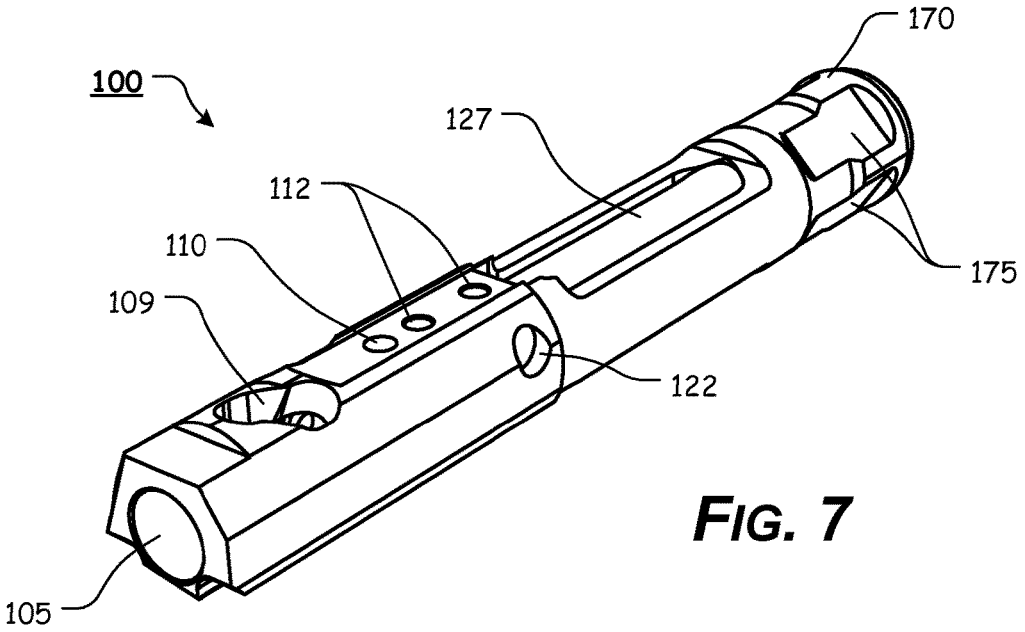
FIG. 7 illustrates an upper, left, front perspective view of an exemplary embodiment of a bolt carrier, as disclosed herein.
Figure 8:
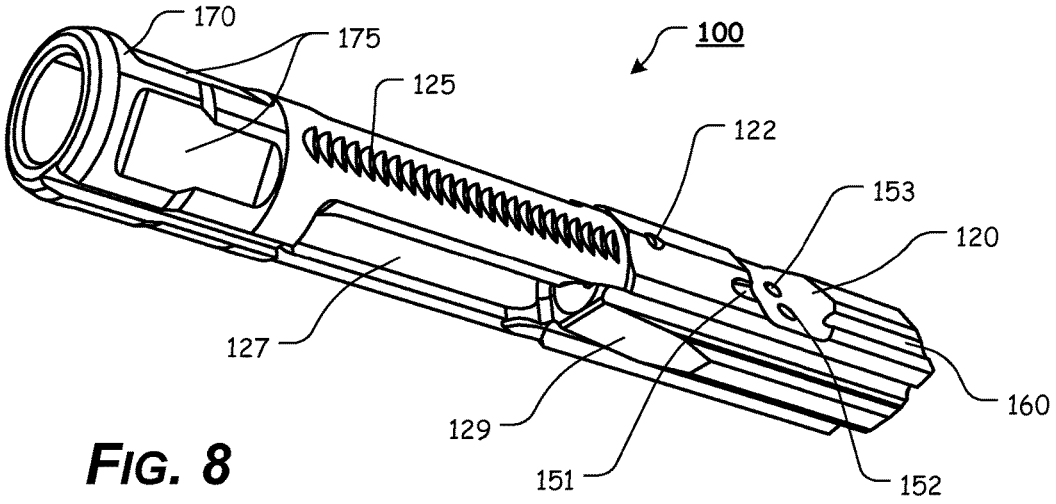
FIG. 8 illustrates a lower, right, rear perspective view of an exemplary embodiment of a bolt carrier, as disclosed herein.
Figure 9:
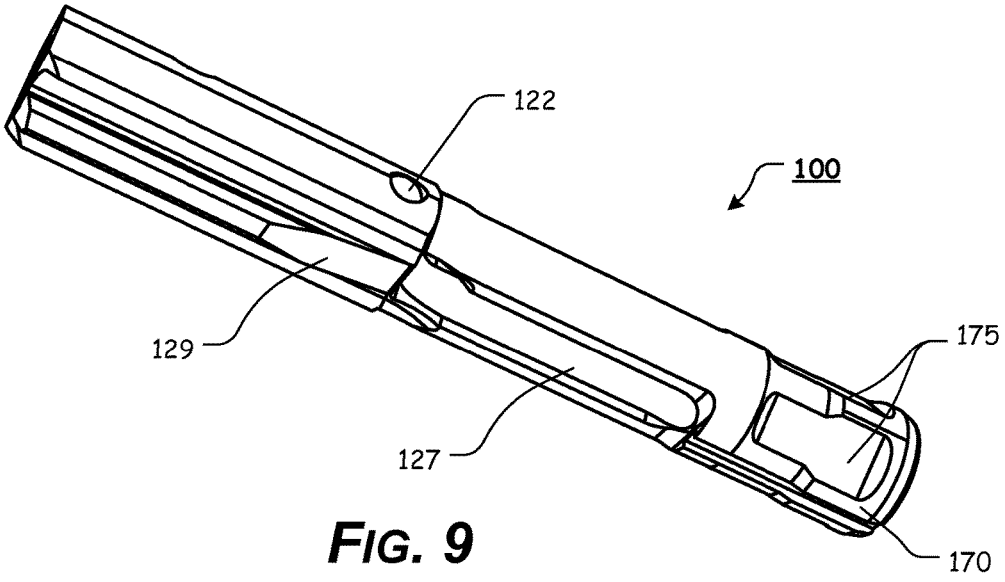
FIG. 9 illustrates a lower, left, front perspective view of an exemplary embodiment of a bolt carrier, as disclosed herein.
Figure 10:
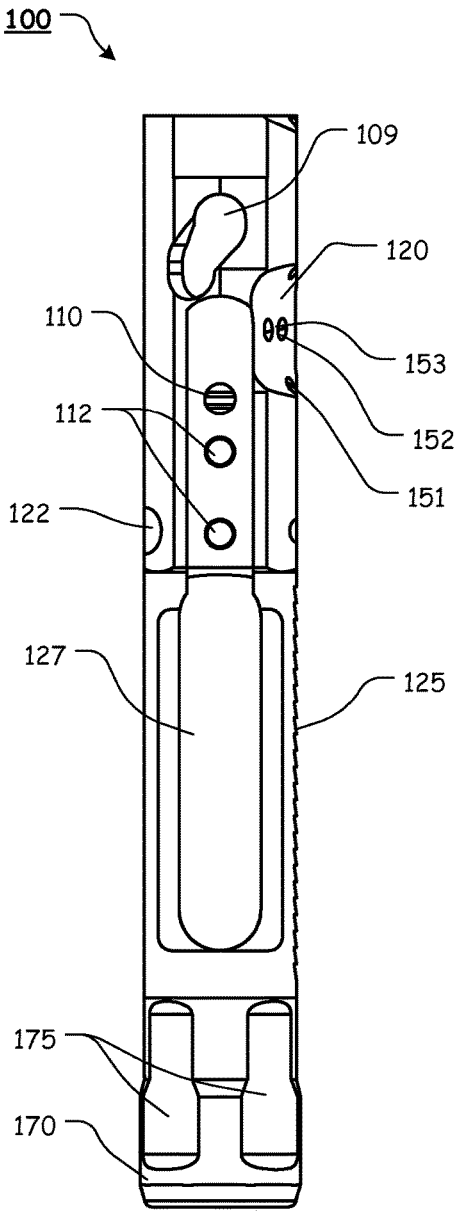
FIG. 10 illustrates a top plan view of an exemplary embodiment of a bolt carrier, as disclosed herein.
Figure 11:
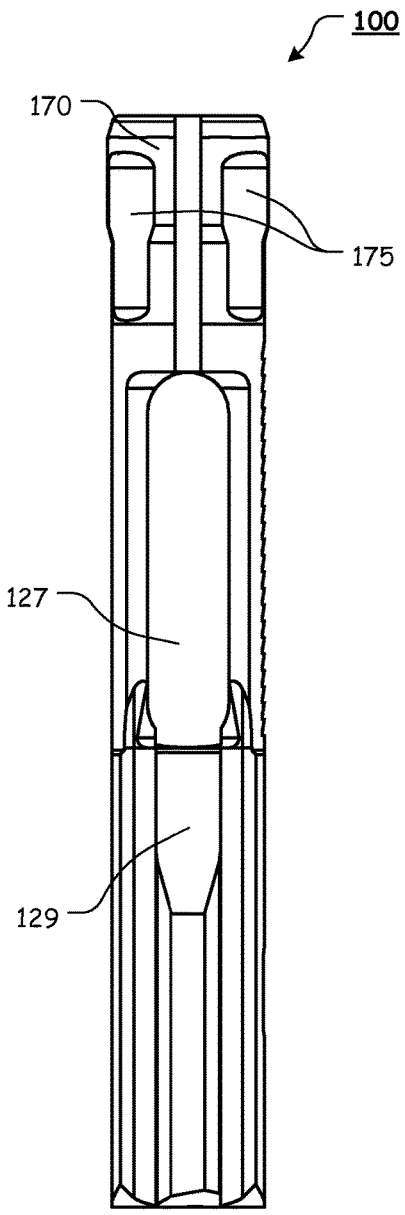
FIG. 11 illustrates a bottom plan view of an exemplary embodiment of a bolt carrier, as disclosed herein.
Figure 12:
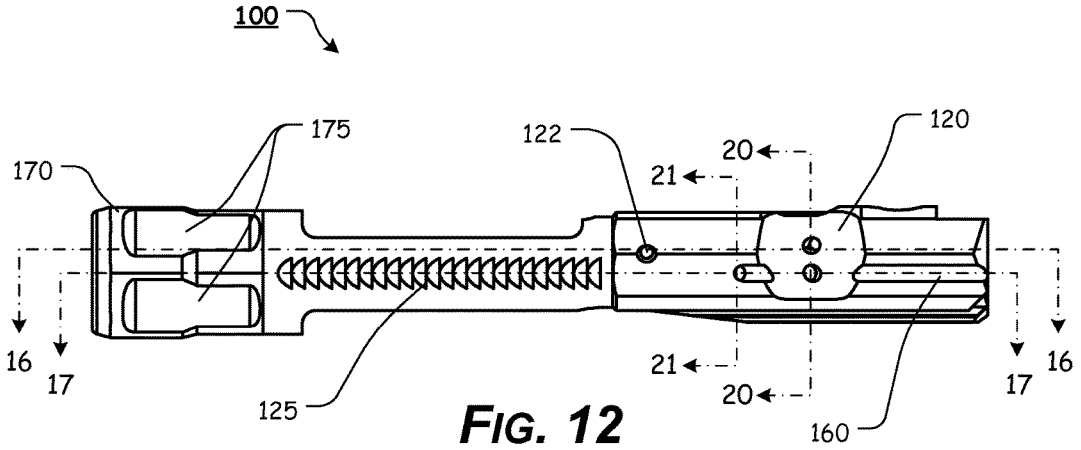
FIG. 12 illustrates a right side view of an exemplary embodiment of a bolt carrier, as disclosed herein.
Figure 13:
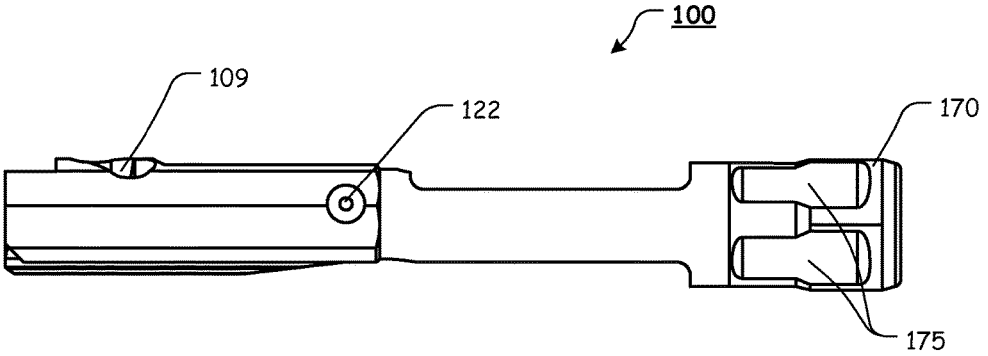
FIG. 13 illustrates a left side view of an exemplary embodiment of a bolt carrier, as disclosed herein.
Figure 14:
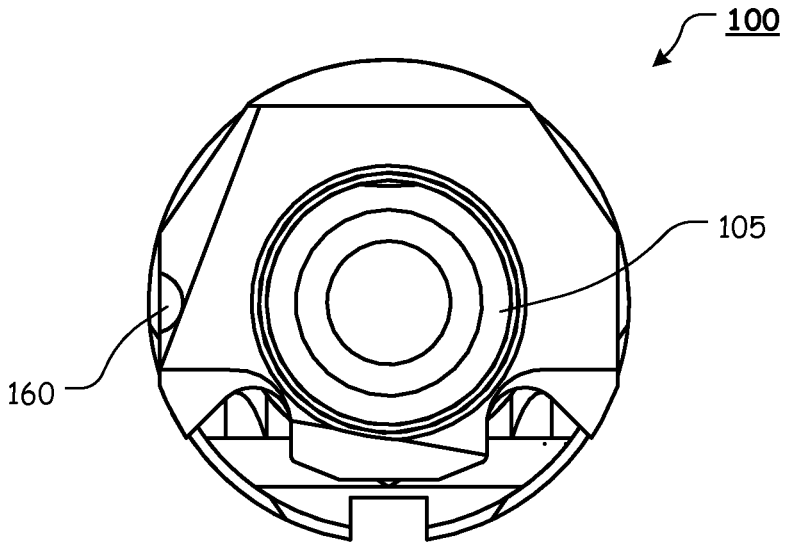
FIG. 14 illustrates a front view of an exemplary embodiment of a bolt carrier, as disclosed herein.
Figure 15:
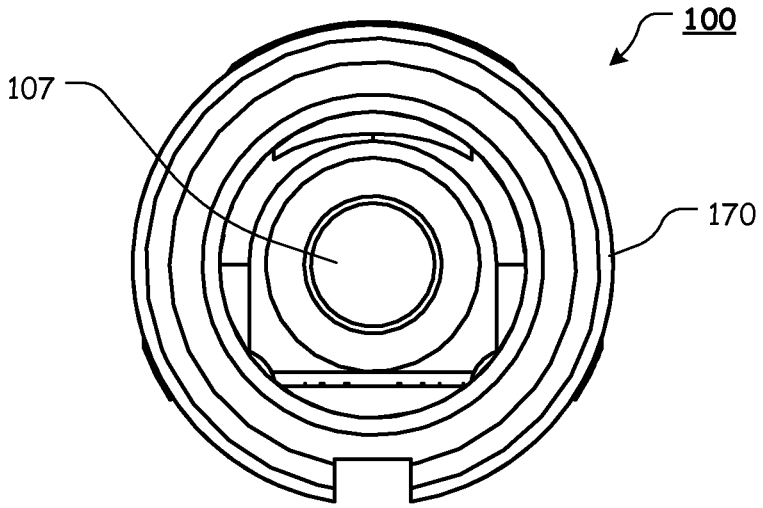
FIG. 15 illustrates a rear view of an exemplary embodiment of a bolt carrier, as disclosed herein.
Figure 16:
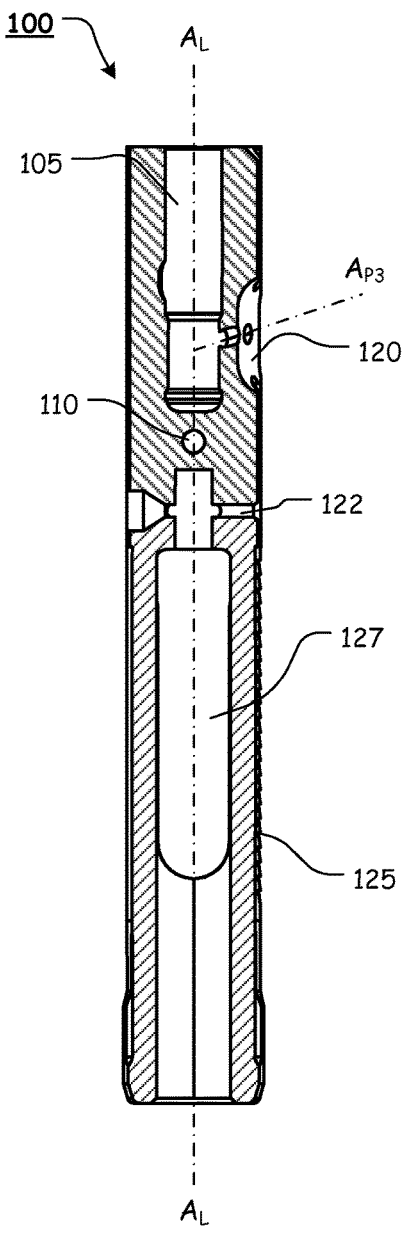
FIG. 16 shows a top cross-sectional view taken along line 16-16 of the bolt carrier of FIG. 12, illustrating the first exemplary embodiment of the bolt carrier as disclosed herein in greater detail.
Figure 17:
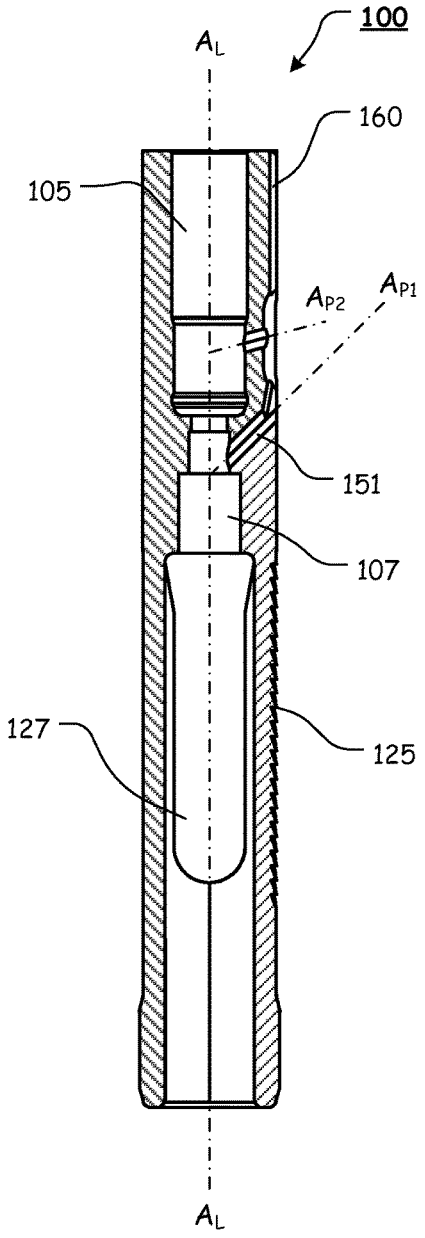
FIG. 17 shows a top cross-sectional view taken along line 17-17 of the bolt carrier of FIG. 12, illustrating the first exemplary embodiment of the bolt carrier as disclosed herein in greater detail.
Figure 18:
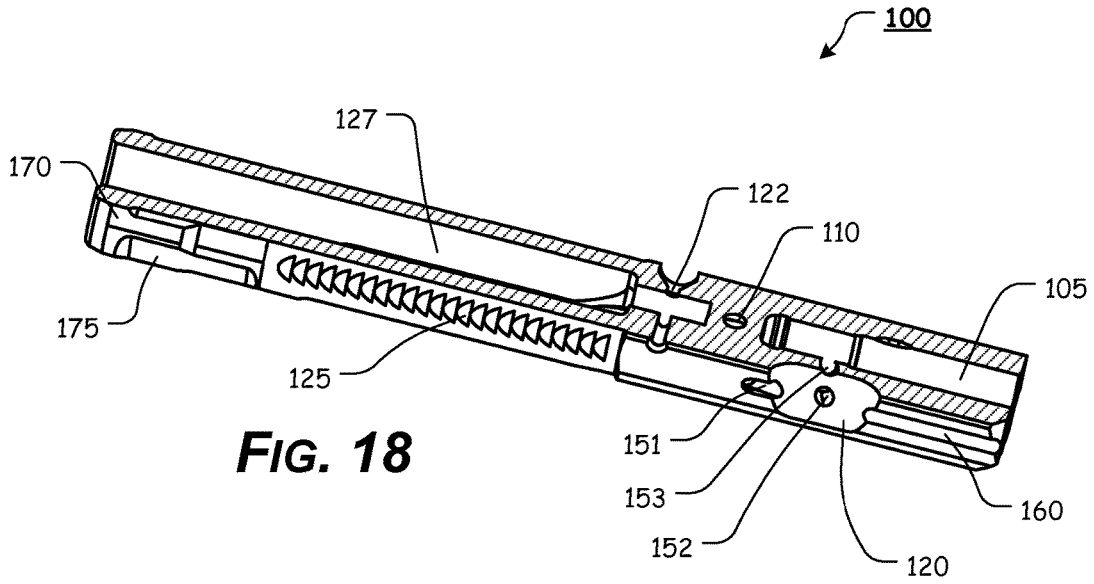
FIG. 18 shows a perspective cross-sectional view taken along line 16-16 of the bolt carrier of FIG. 12, illustrating the first exemplary embodiment of the bolt carrier as disclosed herein in greater detail.
Figure 19:
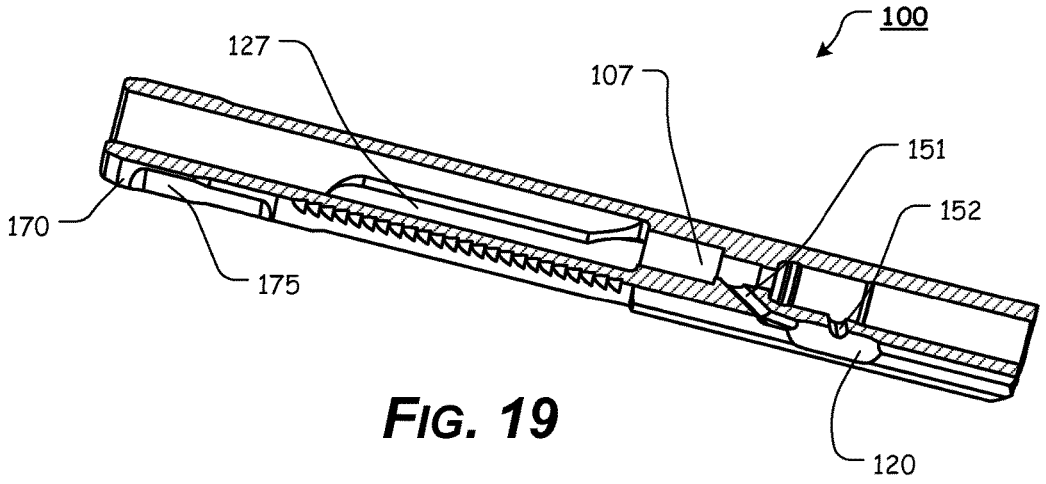
FIG. 19 shows a perspective cross-sectional view taken along line 17-17 of the bolt carrier of FIG. 12, illustrating the first exemplary embodiment of the bolt carrier as disclosed herein in greater detail.

It should be appreciated that the bolt carrier 100 includes many of the features of the standard bolt carrier 20, as illustrated in FIGS. 1-3. For example, the bolt carrier 100 includes one or more bolt carrier key threaded apertures 112 formed so as to allow a bolt carrier key, such as, for example, bolt carrier key 40, to be attached or coupled atop the bolt carrier 100, such that the key gas aperture 110 is in fluid communication with, for example, the gas aperture 42 of the bolt carrier key 40.

A hammer relief 127, having a hammer ramp 129, is formed in at least a portion of the bolt carrier 100. In certain exemplary, nonlimiting embodiments, a plurality of forward assist grooves 125 may optionally be formed along a portion of the bolt carrier 100.

A firing pin retaining pin aperture 122 is formed through a portion of the bolt carrier 100 so as to retain a firing pin retaining pin, such as, for example, a standard firing pin retaining pin 60.

If included, an ejection port door recess 120 allows the bolt carrier 100 to interact with at least a portion of an ejection port cover door to allow the ejection port cover door to be maintained in a closed position when the bolt carrier 100 is in a forward position and automatically opened, when the bolt carrier is moved rearward, from the forward position.

Additionally, the cam pin slot 109 is formed so as to interact with a cam pin, such as, for example, a cam pin 30. Thus, it should be appreciated that the bolt carrier 100 is operable within a firearm, similar to the operation of the standard bolt carrier 20.

It should also be appreciated that a more detailed explanation of the standards elements and/or features of a known bolt carrier, instructions regarding how to install and use the bolt carrier, and certain other items and/or techniques necessary for the implementation and/or operation of the various exemplary embodiments of the presently disclosed bolt carrier 100 are not provided herein because such elements are commercially available and/or such background information will be known to one of ordinary skill in the art. Therefore, it is believed that the level of description provided herein is sufficient to enable one of ordinary skill in the art to understand, produce, and utilize the bolt carrier 100, as described.

In various exemplary embodiments, a primary or first gas port 151 provides fluid communication between the interior and the exterior of the bolt carrier 100 and, more specifically, between the bolt receiving aperture 105 and/or the firing pin receiving aperture 107 and the exterior of the bolt carrier 100.

The first gas port 151 has an initial portion with a longitudinal axis, $A_{P1}$, which is approximately 45° from the longitudinal axis, $A_L$, of the bolt carrier 100 or the bolt receiving aperture 105 of the bolt carrier 100. In certain exemplary embodiments, the longitudinal axis, $A_{P1}$, of the initial portion of the first gas port 151 may extend approximately 40° to 50° from the longitudinal axis, $A_L$, of the bolt carrier 100 or the bolt receiving aperture 105. In still other exemplary embodiments, the longitudinal axis, $A_{P1}$, of the initial portion of the first gas port 151 may extend approximately 30° to 60° from the longitudinal axis, $A_L$, of the bolt carrier 100 or the bolt receiving aperture 105.

A subsequent portion of the first gas port 151 forms a shroud for the first gas port 151 and extends forward at approximately 10° relative to the longitudinal axis, $A_L$, of the bolt carrier 100 or the bolt receiving aperture 105 of the bolt carrier 100. In various exemplary embodiments, the shroud for the first gas port 151 may extend at approximately 9° to 11° relative to the longitudinal axis, $A_L$, of the bolt carrier 100 or the bolt receiving aperture 105. In still other exemplary embodiments, the shroud for the first gas port 151 may extend at approximately 5° to 15° relative to the longitudinal axis, $A_L$, of the bolt carrier 100 or the bolt receiving aperture 105.

In certain exemplary embodiments, the first gas port 151 extends through the bolt carrier 100 in a main body portion of the bolt carrier 100. Alternatively, the first gas port 151 may extend through the bolt carrier 100 within or proximate the ejection port door recess 120.

The diameter of the first gas port 151 is a design choice based upon the desired amount of expelled gases that are to flow through the first gas port 151.

During use, as gasses are expelled into the cavity of the bolt carrier 100, the gasses are vented from the first gas port 151 (and the first gas port 151 shrouded portion) so that the gasses are ported in a forward direction or angle at a point further forward, toward the breech of the upper receiver. As the bolt carrier 100 moves backwards inside the upper receiver, during cycling, the shrouded first gas port 151 causes excess propellant gas to flow forward and substantially parallel with the inside of the upper receiver. This is unlike the gas ports of typical bolt carriers, which expel propellant gases 90° (or perpendicular) to the longitudinal axis, $A_L$, of the bolt carrier 100 or the bolt receiving aperture 105 of the bolt carrier 100 and expel the propellant gases against the inside of the upper receiver, causing increased fouling in all directions.

To further aid in the expulsion of propulsion gases, a gas trough 160 may optionally be formed along at least a portion of the exterior of the bolt carrier 100. In various exemplary embodiments, the gas trough 160 is formed substantially parallel to the first gas port 151. In this manner, as the bolt carrier 100 cycles rearward within the upper receiver of the firearm, excess propellant gases can still be directed forward of the bolt carrier 100 and out of the ejection port, via the gas trough 160.

The overall depth, size, shape, and profile of the shroud and the gas trough 160 are design choices based upon the desired functionality, performance, and/or appearance of the shroud and the gas trough 160.

The second gas port 152 and the third gas port 153 comprise apertures that provide further fluid communication between the interior and the exterior of the bolt carrier 100 and, more specifically, between the bolt receiving aperture 105 and the exterior of the bolt carrier 100. In various exemplary embodiments, the second gas port 152 and the third gas port 153 comprise enlarged apertures, each having a longitudinal axis, $A_{P2}$ and $A_{P3}$, respectively. The diameter of the second gas port 152 and the third gas port 153 is a design choice based upon the desired amount of expelled gases that are to flow through the second gas port 152 and the third gas port 153.

Typically, the longitudinal axis, $A_{P2}$ and $A_{P3}$, of the second gas port 152 and the third gas port 153, respectively, are angled slightly forward. In certain exemplary, nonlimiting embodiments, the longitudinal axis, $A_{P2}$ and $A_{P3}$ are angled at approximately 70° to 75°, relative to the longitudinal axis, $A_L$, of the bolt carrier 100 or the bolt receiving aperture 105 of the bolt carrier 100. In various exemplary embodiments, the longitudinal axis, $A_{P2}$ and $A_{P3}$ may extend at approximately 65° to 80°, relative to the longitudinal axis, $A_L$, of the bolt carrier 100 or the bolt receiving aperture 105 of the bolt carrier 100. In still other exemplary embodiments, the longitudinal axis, $A_{P2}$ and $A_{P3}$ may extend at approximately 60° to 85°, relative to the longitudinal axis, $A_L$, of the bolt carrier 100 or the bolt receiving aperture 105 of the bolt carrier 100.

In various exemplary embodiments, the longitudinal axis of the second gas port 152 $A_{P2}$ is parallel to the longitudinal axis of the third gas port 153 $A_{P3}$. In certain alternate embodiments, the longitudinal axis of the second gas port 152 $A_{P2}$ is not parallel to the longitudinal axis of the third gas port 153 $A_{P3}$. Thus, it should be appreciated that the second gas port 152 may direct propellant gases in substantially the same direction as the third gas port 153 or may direct propellant gases in a slightly different direction.

Figure 20:
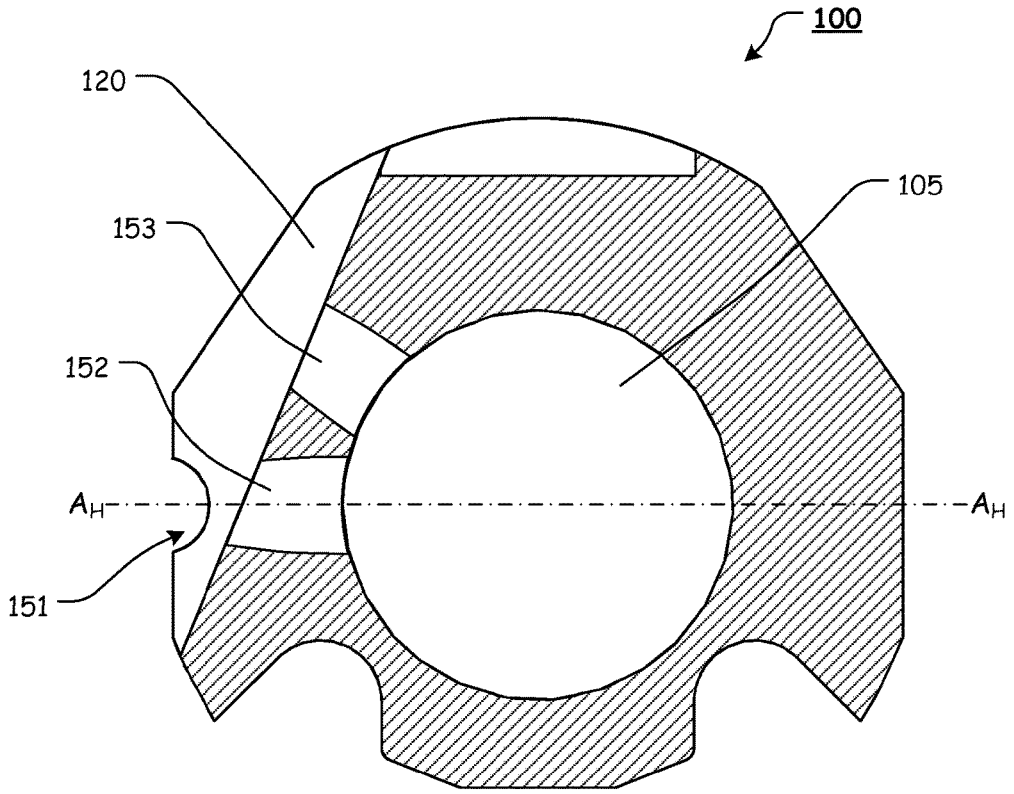
FIG. 20 shows a front cross-sectional view taken along line 20-20 of the bolt carrier of FIG. 12, illustrating the first exemplary embodiment of the bolt carrier as disclosed herein in greater detail.
Figure 21:
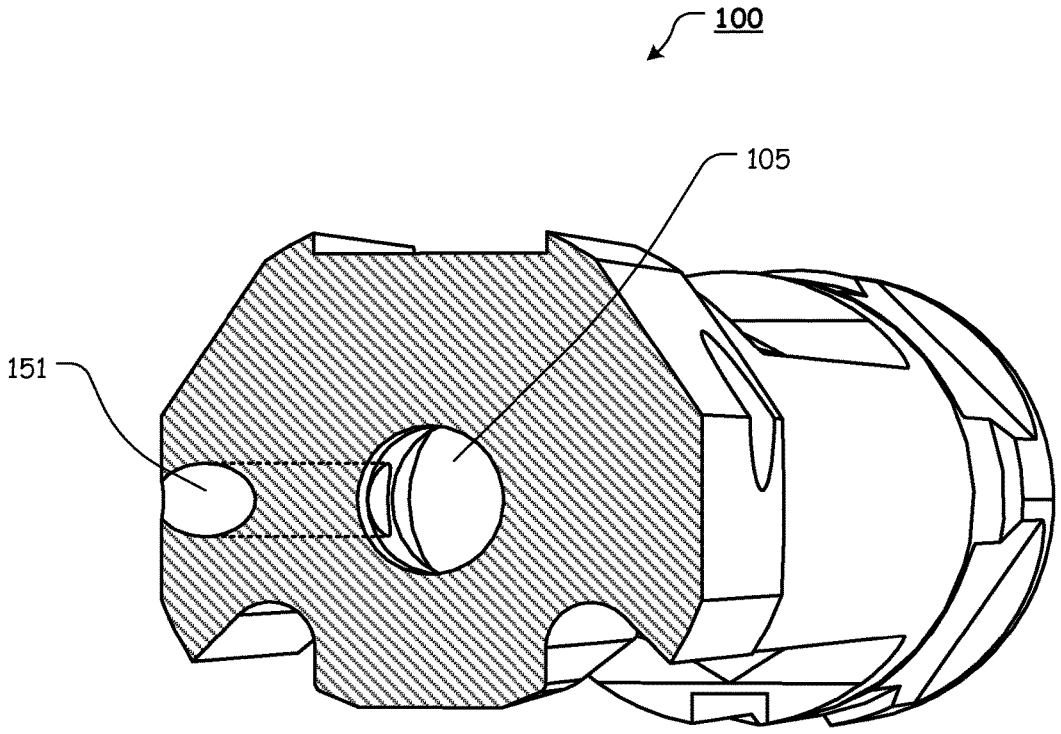
FIG. 21 shows a front, perspective cross-sectional view taken along line 21-21 of the bolt carrier of FIG. 12, illustrating the first exemplary embodiment of the bolt carrier as disclosed herein in greater detail.

As illustrated most clearly in FIGS. 20 and 21, the second gas port 152 and the first gas port 151 extend substantially laterally, along a central, horizontal axis, $A_H$, of the bolt carrier 100 or the bolt receiving aperture 105 of the bolt carrier 100. It should be appreciated that in certain, alternative embodiments, the second gas port 152 and the first gas port 151 may extend at an angle relative to the central, horizontal axis, $A_H$.

The third gas port 153 extends from the bolt receiving aperture 105 at an angle relative to the central, horizontal axis, $A_H$. In various exemplary embodiments, the third gas port 153 extends from the bolt receiving aperture 105 at an angle of approximately 35° relative to the central, horizontal axis, $A_H$. In this manner, not only is a portion of the propellant gas expelled and directed forward of the bolt carrier 100, but is also expelled and directed upward, relative to the bolt carrier 100.

In various exemplary embodiments, the third gas port 153 may extend from the bolt receiving aperture 105 at an angle of between 30° and 40° relative to the central, horizontal axis, $A_H$. In still other exemplary embodiments, the third gas port 153 may extend from the bolt receiving aperture 105 at an angle of between 25° and 45° relative to the central, horizontal axis, $A_H$.

In certain exemplary, nonlimiting embodiments, the second gas port 152 and the third gas port 153 apertures are enlarged and cut so that they are angled slightly forwards and in a narrower vertical angle. Thus, during the cycling of the bolt carrier 100, a greater amount of propellant gas flows out of the bolt carrier 100 at the time of unlocking and at a tighter angle and more forward. Effectively, the bolt carrier 100 of the present disclosure is able to expel more propellant gases through the ejection port opening of the upper receiver.

Additionally, because of the configuration of the first gas port 151, as propellant gases exit the first gas port 151, the propellant gases are forced across the path of the gases being expelled from the second gas port 152, at least partially disrupting the flow of propellant gasses from the second gas port 152 and further urging the propellant gasses from the second gas port 152 forward of the bolt carrier 100, toward and potentially through the gas trough 160.

As illustrated, the rear portion of the bolt carrier 100 includes a larger diameter boss 170 that extends from the main body portion of the bolt carrier 100. Generally, the outer diameter of the boss 170 is greater than the outer diameter of the main body portion of the bolt carrier 100.

The boss 170 is formed so as to reduce the gap between the outer surface of the boss 170 and the inner surface of the upper receiver and/or inner diameter of the buffer tube of the firearm. Thus, the larger diameter boss 170 assists in holding the bolt carrier 100 at a more consistent angle within the upper receiver. By providing the larger diameter boss 170, the bolt carrier 100 is able to maintain more contact with the interior surfaces of the upper receiver and/or interior surfaces of the buffer tube and, unlike known bolt carriers, will not hang off of the bolt during cycling.

Additionally, because the bolt carrier 100 of the present disclosure is able to maintain more contact with the interior surface of the upper receiver and/or buffer tube, the bolt carrier 100 is able to be positioned, or sit, in a more parallel fashion, relative to the inside of the upper receiver. This provides for more consistent bolt positioning within the barrel extension, ultimately increasing the accuracy of the firearm.

In various exemplary embodiments, relief cuts 175 are formed in the rear portion and/or boss 170 portion of the bolt carrier 100 so as to reduce or minimize the amount of surface area that is in contact with the inside of the upper receiver, while still maintaining sufficient contact with the inside of the upper receiver and the buffer tube to maintain the parallel positioning of the bolt carrier 100. Thus, in certain exemplary embodiments, the degree of friction between the boss 170 and the upper receiver and/or buffer tube can be reduced. Additionally, the relief cuts 175 may optionally act to provide debris channels for debris to be moved away from the contact area of the boss 170.

It is believed that the level of description provided herein is sufficient to enable one of ordinary skill in the art to understand and practice the present invention, as described.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A bolt carrier, comprising:

a first gas port, wherein said first gas port provides fluid communication between an interior and an exterior of said bolt carrier, wherein said first gas port extends from an initial portion to a subsequent portion, wherein said initial portion has a longitudinal axis that is offset 30° to 60° from a longitudinal axis of said bolt carrier, and wherein said subsequent portion has a longitudinal axis that is offset 10° to 15° from said longitudinal axis of said bolt carrier;

a second gas port, wherein said second gas port provides fluid communication between an interior and an exterior of said bolt carrier, and wherein said second gas port has a longitudinal axis that is offset 70° to 75° from said longitudinal axis of said bolt carrier; and a third gas port, wherein said third gas port provides fluid communication between an interior and an exterior of said bolt carrier, and wherein said third gas port has a longitudinal axis that is offset 30° to 40° from said longitudinal axis of said bolt carrier.

2. The bolt carrier of claim 1, wherein said first gas port provides fluid communication between a bolt receiving aperture and/or a firing pin receiving aperture and an exterior of said bolt carrier.

3. The bolt carrier of claim 1, wherein said initial portion has a longitudinal axis that is offset 40° to 50° from said longitudinal axis of said bolt carrier.

4. The bolt carrier of claim 1, wherein said initial portion has a longitudinal axis that is offset 45° from said longitudinal axis of said bolt carrier.

5. The bolt carrier of claim 1, wherein said subsequent portion has a longitudinal axis that is offset 9° to 11° from said longitudinal axis of said bolt carrier.

6. The bolt carrier of claim 1, further comprising
a boss formed proximate a rear portion of said bolt carrier.

7. The bolt carrier of claim 6, further comprising
one or more relief cuts in said boss.

8. The bolt carrier of claim 1, further comprising
one or more relief cuts formed proximate a rear portion of said bolt carrier.

9. The bolt carrier of claim 1, further comprising
a gas trough formed along at least a portion of said exterior of said bolt carrier.

10. The bolt carrier of claim 9, wherein said gas trough is formed substantially parallel to said first gas port.

11. A bolt carrier, comprising:

a first gas port, wherein said first gas port provides fluid communication between an interior and an exterior of said bolt carrier, wherein said first gas port extends from an initial portion to a subsequent portion, wherein said initial portion has a longitudinal axis that is offset 30° to 60° from a longitudinal axis of said bolt carrier, and wherein said subsequent portion has a longitudinal axis that is offset 10° to 15° from said longitudinal axis of said bolt carrier; and a second gas port, wherein said second gas port provides fluid communication between an interior and an exterior of said bolt carrier, and wherein said second gas port has a longitudinal axis that is offset 70° to 75° from said longitudinal axis of said bolt carrier.

12. The bolt carrier of claim 11, wherein said first gas port provides fluid communication between a bolt receiving aperture and a firing pin receiving aperture and an exterior of said bolt carrier.

13. The bolt carrier of claim 11, wherein said second gas port provides fluid communication between a bolt receiving aperture and/or a firing pin receiving aperture and an exterior of said bolt carrier.

14. The bolt carrier of claim 11, wherein said initial portion of said first gas port has a longitudinal axis that is offset 40° to 50° from said longitudinal axis of said bolt carrier.

15. The bolt carrier of claim 11, further comprising a boss formed proximate a rear portion of said bolt carrier.

16. The bolt carrier of claim 15, further comprising one or more relief cuts in said boss.

17. The bolt carrier of claim 11, further comprising a gas trough formed along at least a portion of said exterior of said bolt carrier.

18. A bolt carrier, comprising:

a gas port, wherein said first gas port provides fluid communication between an interior and an exterior of said bolt carrier, wherein said gas port extends from an initial portion to a subsequent portion, wherein said initial portion has a longitudinal axis that is offset 30° to 60° from a longitudinal axis of said bolt carrier, and wherein said subsequent portion has a longitudinal axis that is offset 10° to 15° from said longitudinal axis of said bolt carrier.

19. The bolt carrier of claim 18, wherein said first gas port provides fluid communication between a firing pin receiving aperture and an exterior of said bolt carrier.

20. The bolt carrier of claim 18, wherein said first gas port has a longitudinal axis that is offset 45° from said longitudinal axis of said bolt carrier.

* * * * *